United States Patent [19]

Mcquaid et al.

[11] Patent Number: 4,746,896

[45] Date of Patent: May 24, 1988

[54] LAYERED FILM RESISTOR WITH HIGH RESISTANCE AND HIGH STABILITY

[75] Inventors: James G. Mcquaid, Mineral Wells; Stanley L. Bowlin, Weatherford, both of Tex.

[73] Assignee: North American Philips Corp., New York, N.Y.

[21] Appl. No.: 861,039

[22] Filed: May 8, 1986

[51] Int. Cl.[4] ..... H01C 1/012

[52] U.S. Cl. ..... 338/314; 338/308; 29/610 R; 29/620; 427/103

[58] Field of Search ..... 338/314, 195, 320, 309; 148/127; 29/620, 610 R; 427/126.6, 123, 101, 103

[56] References Cited

U.S. PATENT DOCUMENTS

| | | | |
|---|---|---|---|
| 2,935,717 | 5/1960 | Solow | 338/308 |
| 3,325,258 | 6/1967 | Fottler | 29/183.5 |
| 3,356,982 | 12/1967 | Solow | 338/308 |
| 3,462,723 | 8/1969 | Phillips | 338/7 |
| 3,673,539 | 6/1972 | Healey | 338/154 |
| 3.996.551 | 12/1976 | Croson | 338/314 X |
| 4,019,168 | 4/1977 | Collins | 338/309 |
| 4,104,607 | 8/1978 | Jones | 338/309 |
| 4,454,495 | 6/1984 | Werner et al. | 338/195 |
| 4,520,342 | 5/1985 | Vugts | 338/308 |

FOREIGN PATENT DOCUMENTS

| | | |
|---|---|---|
| 1640089 | 9/1971 | Fed. Rep. of Germany . |
| 1586857 | 3/1981 | United Kingdom . |

OTHER PUBLICATIONS

Chem. Abs. 101 121104Z, (1984), Multilayer Structure of resistant chromium—aluminum products by vacuum evaporation.

*Primary Examiner*—H. Broome
*Assistant Examiner*—M. M. Lateef
*Attorney, Agent, or Firm*—Ernestine Bartlett

[57] ABSTRACT

A high stability, high resistance metal film resistor having layered metallic films deposited and annealed such that one layer has a positive TCR and a negative TCR Slope, while a second layer has a negative TCR and a positive TCR Slope, thereby yielding a resistive film having TCR and a TCR Slope approaching zero.

9 Claims, 1 Drawing Sheet

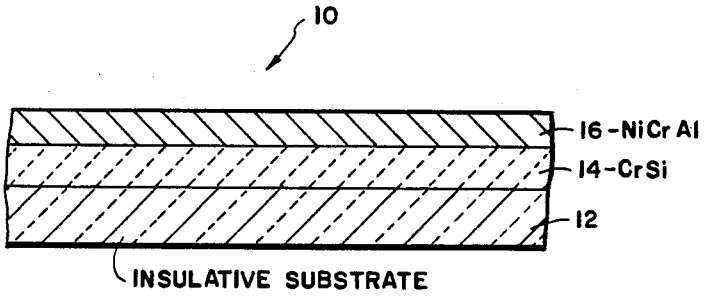
10
16 - NiCr Al
14 - CrSi
12
INSULATIVE SUBSTRATE

LAYERED FILM RESISTOR WITH HIGH RESISTANCE AND HIGH STABILITY

BACKGROUND OF THE INVENTION

1. Field of the Invention

The invention relates to metal film resistors and in particular to resistors having two or more layers of a metallic film deposited on an insulative substrate, wherein at least two different metallic compositions are deposited alternately in the sequence of layers. Alternating metallic compositions in a layered resistive film structure provides a technique for controlling the TCR and the TCR Slope of the resistive film.

2. Description of the Prior Art

Metal film resistors are typically made by single target sputtering of a metallic alloy composition on an insulative substrate and subjecting the resulting sputtered substrate to a heat treatment in air at approximately 300° C. Typically either a ceramic core or a ceramic chip is utilized as the substrate. The resistive films used are typically alloys of nickel and chrome with some other metals used in lesser percentages. Sputtered or evaporated NiCr alloys are widely used as deposited resistive film.

The desired TCR is obtained by heat treating the resistive film. The range of time and temperature for the heat treatment is usually a function of the desired temperature coefficient of resistance (TCR) of the resistor. During the heat treatment there is a growth of crystals in the bulk of the resistive film applied to the substrate; the larger the crystals, the more positive the TCR will be. However, during heat treatment crystals on the surface of the metal film break down and surface oxidation takes place, causing the TCR to be less positive in that area. With the addition of a heat treatment to the process of making resistors, the net effect is that for most resistors the TCR will be positive because crystal growth is promoted in the bulk of the metal film. To prevent the TCR from becoming too positive, contaminants can be introduced into the sputtering process. Reactive sputtering can be used concurrently for TCR control. However, only TCR is controlled thereby, not TCR Slope.

One problem with prior art metal film systems for resistor applications is that the TCR Slope cannot be controlled. Controlling the TCR Slope enables one to produce a resistor whose operation is more independent of temperature and is therefore more stable. Ideally, a TCR of 0 (zero) and a TCR Slope of 0 (zero) is desirable. To control to the TCR Slope and thereby obtain a TCR approaching 0 (zero) over a wide range of factors, a layering of metallic films of differing material composition has been found to be effective. The present invention is directed to a layered metal film resistor having significantly higher stability than prior art metal film resistors and having a significantly higher resistance in ohms per square than prior art metal film resistors.

SUMMARY OF THE INVENTION

The object of this invention is to provide a high stability, high resistance metal film resistor with a sheet resistance of 2000 to 15000 ohms per square.

A further object of the invention is to privide a resistive film system which yields much higher resistances than previous resistive films, while exhibiting good temperature characteristics and high stability.

A further object of the invention is to provide high resistance, high stability resistors to be made on much smaller substrates than were previously possible.

The objects of the invention are achieved by depositing one layer of each of two different conductive films on an insulating substrate. A first layer of metal silicides, such as chromium-silicon (CrSi), is reactively deposited by sputtering in an argon and nitrogen mixture. This layer is annealed at 500° C. in air for sixteen hours. A second layer of a metal alloy, such as a nickel-chromium-aluminum alloy (NiCrAl), is deposited by sputtering coextensively over the first layer. This layer, together with the first layer, is then annealed at 300° C. in air for sixteen hours.

The chromium-silicon under-layer has a positive temperature coefficient of resistance with a negative TCR Slope. The nickel-chromium-aluminum over-layer has a negative temperature coefficient of resistance with a positive TCR Slope. The combined effect of the two layers is a TCR near 0 (zero) and a TCR Slope of 0 (zero). This resistive material system allows high resistance, high stability resistors to be made on much smaller substrates than were previously possible.

BRIEF DESCRIPTION OF THE DRAWING

The FIGURE is a cross-sectional view of a layered metal film resistor according to the invention.

DESCRIPTION OF THE PREFERRED EMBODIMENT

This invention provides a high stability metal film with a sheet resistance of 2000 to 15000 ohms per square by using a layered resistive material system in which the metals or alloys of each layer have complimentary temperature characteristics which offset one another in the film processing. A resistive material film having good temperature characteristics, high resistance and high stability can be achieved through a material system which allows control of the temperature coefficient of resistance (TCR) (the first derivative of resistance with respect to temperature), and the temperature coefficient of resistance Slope (TCR Slope) (the second derivative of resistance with respect to temperature). In this invention, control over the TCR and TCR Slope is achieved through the use of a layered film system. The first or under-layer is selected to have a positive TCR with a negative TCR Slope. The second or over-layer is selected to have a negative TCR with a positive TCR Slope. The combined effect of the layers is that the resistive film will have a near 0 (zero) TCR and a TCR Slope of 0 (zero).

A preferred embodiment of a metal film resistor 10 is illustrated in cross-section in the FIGURE. Resistor 10 has an insulative substrate 12, an under-layer 14 of a first conductive film and an over-layer 16 of a second conductive film.

In the preferred embodiment, two metallic layers are used on an insulative substrate, each layer being a conductive film having a material composition differing from the other layer in TCR and TCR Slope.

A first layer 14 of metal silicides, such as chromium-silicon (CrSi), is reactively deposited on insulative substrate 12 by sputtering in an argon and nitrogen mixture. This layer is annealed at 500° C. for sixteen (16) hours in air.

A second layer 16 of a metal alloy, such as a nickel-chromium-aluminum alloy (NiCrAl), is deposited coextensively over said first layer 14 by sputtering in argon.

The second layer 16, together with the first layer 14, is annealed at approximately 300° C. for sixteen (16) hours in air.

The CrSi under-layer 14 has a positive TCR with a negative TCR Slope. The NiCrAl over-layer 16 has a negative TCR with a positive TCR Slope. The combined effect of the two layers is to provide a resistive film on a substrate 12 having a TCR near 0 (zero) and a TCR Slope of 0 (zero).

After the conventional steps of laser trimming to adjust resistance value and tolerance and the addition of terminations, the resulting product is a resistor having high stability and high resistance in ohms per square.

The layered film of this invention may be deposited by other methods such as thermal evaporation, ion beam deposition, chemical vapor deposition, or ARC vapor deposition.

The substrate 12 may be any of various materials such as ceramic, glass, sapphire or other insulative material suitable for the deposition method used. The substrate 12 may be flat or cylindrical.

Other metal silicides and metal alloys may be utilized. The alternatives must compliment each other in TCR and TCR Slope.

For the preferred embodiment, test results of three batches of ten units of finished resistors indicate the following.

| | TCR Slope | TCR @ 85° C. | Ohms/Sq. | Resistance |
|---|---|---|---|---|
| CrSi under-layer | −19.2 | 29.5 | 5517 | 3476Ω |
| Both layers | −2.6 | −1.2 | 3938 | 2481Ω |
| CrSi under-layer | −19.0 | 22.7 | 11914 | 7506Ω |
| Both layers | 4.7 | 2.9 | 7830 | 4933Ω |
| CrSi under-layer | −19.3 | 38.3 | 7538 | 4749Ω |
| Both layers | | | | |

When resistance is plotted against temperature, the following equation explains this effect.

$$\frac{1}{R_{CrSi}} + \frac{1}{R_{NiCrAl}} = \frac{1}{R_T}$$

The second layer 16 may also be reactively sputtered in argon and nitrogen.

What is claimed:

1. A high stability metal film having a sheet resistance of 2000 to 15000 ohms per square comprising:

an insulative substrate;

a first layer of a first conductive metal having a positive TCR and a negative TCR Slope reactively deposited on said substrate and annealed;

a second layer of a second conductive metal having a negative TCR and a positive TCR Slope deposited coextensively over said annealed first layer and annealed with said first layer.

2. The film of claim 1 wherein said first layer is a CrSi metal film derived by reactively sputtered Cr-Si in an argon and nitrogen atmosphere.

3. The film of claim 1 wherein said second layer is NiCrAl and said NiCrAl is sputtered in argon.

4. The film of claim 1 wherein said second layer is a NiCrAl derived by reactively sputtered NiCrAl in argon and nitrogen.

5. A metal film resistor of high stability having a sheet resistance of 2000 to 15000 ohms per square which comprises:

an insulative substrate;

a first layer of a CrSi film derived by reactive sputtering in a nitrogen atmosphere and annealed by heating at a temperature of about 500° C. in air, said layer having a positive TCR and a negative TCR slope;

a second layer of a NiCrAl alloy film applied over said first layer and annealed by heating at a temperature of about 300° in air, said layer having a negative TCR and a positive TCR slope.

6. A metal film resistor as claimed in claim 5 in which the combined effect of the two layers is a TCR near zero and a TCR slope of zero.

7. The method of making a high stability resistive film having a sheet resistance of 2000 to 15000 ohms per square which comprises the steps of:

selecting an insulative substrate;

reactively depositing a first conductive layer of a CrSi film on said substrate in an atmosphere comprising argon and nitrogen, said film having a positive TCR and a negative TCR slope;

subjecting said film bearing substrate to a temperature of 500° C. for a period of time sufficient to anneal the deposited film;

depositing a second conductive film of a NiCrAl alloy over said first conductive layer, said film having a negative TCR and a positive TCR slope; and subjecting the layered substrate to a temperature of 300° C. for a period of time sufficient to anneal the second conductive film.

8. The method of claim 7 in which the combined effect of the two annealed film layers is a TCR near zero and a TCR slope of zero.

9. The method of making a high stability resistive film comprising the steps of:

selecting an insulative substrate;

reactively depositing a first conductive metal film on said substrate wherein said first conductive metal film has a positive TCR and a negative TCR Slope;

annealing said first conductive film;

depositing a second conductive metal film coextensively over said first conductive metal film, wherein said second conductive metal film has a negative TCR and a positive TCR Slope;

annealing said second conductive metal film together with said first conductive metal film.

* * * * *